US005703005A

United States Patent [19]

Torii et al.

[11] Patent Number: 5,703,005

[45] Date of Patent: Dec. 30, 1997

[54] THERMOSENSITIVE COLORING COMPOSITION AND REVERSIBLE THERMOSENSITIVE RECORDING MEDIUM USING SAME

[75] Inventors: Masafumi Torii, Shizuoka; Hiromi Furuya; Masaru Shimada, both of Shizuoka-ken; Kyoji Tsutsui, Mishima, all of Japan

[73] Assignee: Ricoh Company, Ltd., Tokyo, Japan

[21] Appl. No.: 645,754

[22] Filed: May 14, 1996

[30] Foreign Application Priority Data

| | | | |
|---|---|---|---|
| May 15, 1995 | [JP] | Japan | 7-138918 |
| Apr. 11, 1996 | [JP] | Japan | 8-113029 |
| Apr. 26, 1996 | [JP] | Japan | 8-129298 |

[51] Int. Cl.[6] ..... B41M 5/30

[52] U.S. Cl. ..... 503/201; 503/216; 503/225

[58] Field of Search ..... 427/150–152; 503/201, 216, 225

[56] References Cited

U.S. PATENT DOCUMENTS 5,296,439 3/1994 Maruyama et al. ..... 503/201

*Primary Examiner*—Bruce H. Hess

*Attorney, Agent, or Firm*—Oblon, Spivak, McClelland, Maier & Neustadt, P.C.

[57] ABSTRACT

A thermosensitive coloring composition is disclosed which includes a coloring agent and a color developer of the formula:

wherein $R^1$ represents hydrogen, a halogen, a hydroxyl group, an alkyl group or an alkoxy group, $R^2$ represents a $C_{1-8}$ aliphatic hydrocarbon group, A represents a divalent aliphatic hydrocarbon group, B represents a substituted or non-substituted aromatic or aliphatic divalent group, Y and Z each represent a hetero atom-containing divalent group, n is an integer of 1–3 and p and q are each an integer of 0 or 1. A reversible thermosensitive recording medium includes a support and a thermosensitive layer of the above coloring composition formed thereon.

3 Claims, 1 Drawing Sheet

THERMOSENSITIVE COLORING COMPOSITION AND REVERSIBLE THERMOSENSITIVE RECORDING MEDIUM USING SAME

BACKGROUND OF THE INVENTION

This invention relates to a thermosensitive coloring composition capable of reversibly assuming a color development state and a decolorization state depending upon the thermal hysteresis thereof and to a reversible thermosensitive recording medium using the above-mentioned coloring composition.

There is a known thermosensitive recording medium utilizing the coloring reaction between an electron donor compound (hereinafter referred to as a coloring agent) and an electron acceptor compound (hereinafter referred to as a developer). This kind of thermosensitive recording medium is widely used in a variety of applications such as recorders and printers for an electronic computer, a scientific measuring instrument, a facsimile apparatus, a word processor, an automatic ticket vending apparatus and a CRT medical measuring instrument. The known thermosensitive recording media currently actually used are of an irreversible type in which the color development and decolorization cannot be repeated.

There are a number of proposals for a reversible thermosensitive recording medium utilizing a combination of a coloring agent with a developer and capable of reversibly assuming a color development state and a decolorization state. For example, JP-A-(Japanese Laid-Open Patent Application No.) 60-193691 proposes the use of a developer composed of a blend of gallic acid with phloroglucinol and JP-A-60-237684 proposes the use of phenolphthalein or thymolphthalein as a developer. JP-A-62-138556, 62-138568 and 62-140881 suggest a reversible thermosensitive recording layer containing a homogeneous mixture a coloring agent, a developer and a carboxylic acid ester. JP-A-63-173684 proposes the use of an ascorbic acid derivative as a developer, while JP-A-2-188293 and 188294 disclose the use of a higher fatty amine salt of gallic acid or bis(hydroxyphenyl)acetic acid as a developer. The known reversible thermosensitive recording media are, however, unsatisfactory for use in practice. In particular, with the known recording media, it is impossible to obtain both excellent color development state and excellent decolorization state or to obtain a constant image density even when the same recording condition is used.

JP-A-5-124360 discloses a thermosensitive coloring composition containing a leuco compound serving as a coloring agent and an organic phosphoric acid compound with a long chain aliphatic group, a carboxylic compound with a long chain aliphatic group or a phenolic compound with a long chain aliphatic group as a developer, and a reversible thermosensitive recording medium utilizing the above coloring composition. This coloring composition is capable of reversibly assuming a color development state and a decolorization state depending upon the thermal hysteresis thereof. Namely, the composition can achieve the color development when heated at a first temperature and the developed color can be retained when rapidly cooled to room temperature. Further, the developed image can be erased when heated at a second temperature which is lower than the first temperature and the decolorization state is retained when cooled to room temperature.

The thermosensitive recording medium described immediately above gives a satisfactory image density and exhibits good erasability. However, from the standpoint of practical use, there is a problem that the color densities at the developed and erased portions vary upon repeated use.

SUMMARY OF THE INVENTION

It is, therefore, an object of the present invention to provide a thermosensitive coloring composition which can reversibly assume color development and decolorization states depending upon the thermal hysteresis thereof and which is devoid of the drawback of the conventional coloring composition.

Another object of the present invention is to provide a thermosensitive coloring composition of the above-mentioned type which gives a high color density in the color development state but an extremely low color density in the decolorization state.

It is a further object of the present invention to provide a thermosensitive coloring composition of the above-mentioned type which can be quickly converted from the color development state to the decolorization state.

It is yet a further object of the present invention to provide a reversible thermosensitive recording medium having a thermosensitive layer formed of the above thermosensitive coloring composition.

It is yet a further object of the present invention to provide a reversible thermosensitive recording medium of the above-mentioned type whose image density and background density do not vary upon repeated use.

In accomplishing the foregoing objects, there is provided in accordance with the present invention a thermosensitive coloring composition comprising:

a coloring agent, and a color developer capable of reacting with said coloring agent to develop a color, said color developer being a carboxylic acid having the following formula (I):

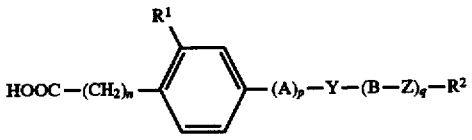

(I)

wherein $R^1$ stands for a substituent selected from the group consisting of a hydrogen atom, a halogen atom, a hydroxyl group, an alkyl group and an alkoxy group, $R^2$ stands for an aliphatic hydrocarbon group having at least 8 carbon atoms, A stands for a divalent aliphatic hydrocarbon group, B stands for a divalent group selected from the group consisting of substituted and non-substituted aromatic groups and substituted and non-substituted aliphatic groups, Y stands for a divalent group containing at least one hetero atom, Z stands for a divalent group containing at least one hetero atom, n is an integer of 1–3 and p and q are each an integer of 0 or 1.

In another aspect, the present invention provides a reversible thermosensitive recording medium, comprising a support, and a thermosensitive recording layer supported on said support and including a coloring agent, and a developer capable of reacting with said coloring agent to develop a color, said color developer being a carboxylic acid having the following formula (I):

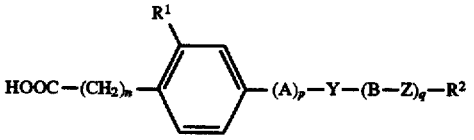

(I)

wherein $R^1$ stands for a substituent selected from the group consisting of a hydrogen atom, a halogen atom, a hydroxyl group, an alkyl group and an alkoxy group, $R^2$ stands for an aliphatic hydrocarbon group having at least 8 carbon atoms, A stands for a divalent aliphatic hydrocarbon group, B stands for a divalent group selected from the group consisting of substituted and non-substituted aromatic groups and substituted and non-substituted aliphatic groups, Y stands for a divalent group containing at least one hetero atom, Z stands for a divalent group containing at least one hereto atom, n is an integer of 1–3 and p and q are each an integer of 0 or 1, wherein said recording layer is capable of:

(a) assuming a color development state when heated at a first temperature at which said coloring agent and said developer are fused and then rapidly cooled to room temperature, and (b) assuming a decolorization state when heated to a second temperature which is lower than said first temperature and maintaining said decolorization state when cooled to room temperature.

BRIEF DESCRIPTION OF THE DRAWING

Other objects, features and advantages of the present invention will become apparent from the detailed description of the preferred embodiments of the invention which follows, when considered in the light of the accompanying drawing in which.

DETAILED DESCRIPTION OF THE PREFERRED EMBODIMENTS OF THE INVENTION

Figure 1:
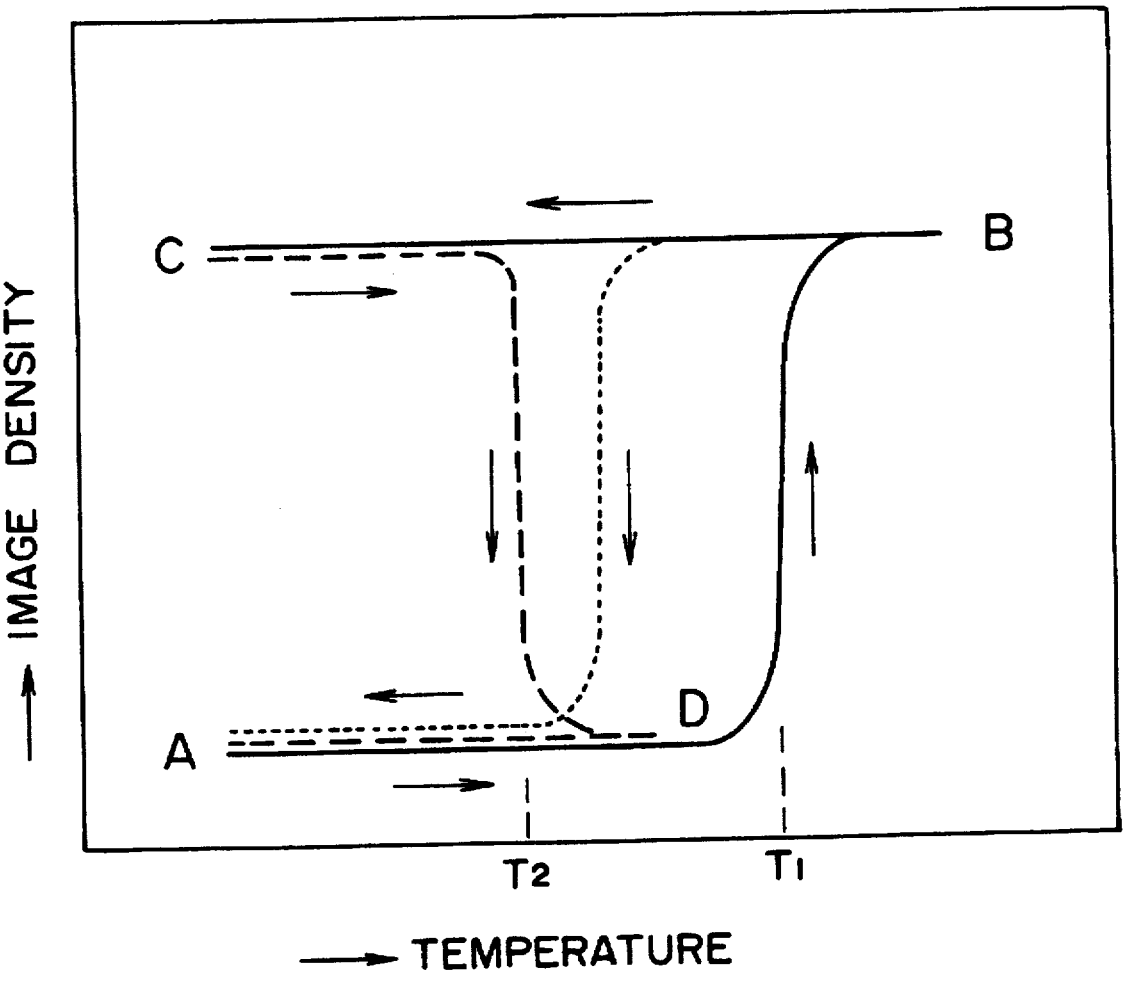
FIG. 1 is a graph which shows the relationship between the image density and the temperature of a reversible thermosensitive recording medium of the present invention and which is explanatory of the principle of the reversible change between a color development state and a decolorization state depending upon the thermal hysteresis thereof.

The thermosensitive recording medium according to the present invention includes a support having supported thereon a thermosensitive recording layer. Any material that can support the thermosensitive recording layer may be used as the support. Examples of suitable support include paper, synthetic paper, plastic film, a glass plate, a metal foil and composite sheets thereof.

The thermosensitive recording layer contains a coloring agent and a carboxylic acid developer having the above formula (I). In the carboxylic acid developer of the formula (I), when the number of the carbon atoms of the aliphatic hydrocarbon group $R^2$ is less than 8, the image developing and erasing properties are unsatisfactory. Preferably, the aliphatic hydrocarbon group $R^2$ has a carbon atom number of at least 11.

The divalent groups Y and Z stand, independently from each other, for a group containing at least one linkage selected from —NH—, —CO—, —O—, —S— and —$SO_2$—.

Illustrative of suitable divalent groups containing at least one linkage selected from —NH—, —CO—, —O—, —S— and —$SO_2$—are an urea linkage (—NH—CO—NH—), an amide linkage (—NH—CO— or —CO—NH—), a thiourea linkage (—NH—CS—NH—), an urethane linkage (—O—CO—NH— or —NH—CO—O—), an amine linkage (—NH—), an azomethyne linkage (—CH=N— or —N=CH—), an ester linkage (—O—CO— or —CO—O—), a thioester linkage (—SC—O— or —CO—S—), an ether linkage (—O—), a thioether linkage (—S—), a sulfonyl linkage (—$SO_2$—), a sulfonamide linkage (—$SO_2$—NH— or —NH—$SO_2$—), a carbonyl linkage (—CO—), and other linkages such as —O—CS—NH—, —NH—CS—O—, —O—CO—O—, —S—S—, —CO—NH—CO—, —CO—NH—CO—NH—, —NH—CO—NH—CO—, —CO—NH—NH—CO—, —NH—CO—CO—NH—, —CO—NH—NH—CO—O—, —CO—NH—NH—CO—NH—, —NH—CO—NH—NH—CO—, —NH—CO—NH—NH— and —NH—NH—CO—NH—.

The divalent aliphatic hydrocarbon group A is preferably an alkylene group and the divalent group B is preferably an alkylene group or a phenylene group.

Specific examples of the carboxylic acid compound of the formula (I) are shown in Tables 1—1 through 1–21.

TABLE 1-1

| Compound No. | n | —$R^1$ | —$(A)_p$— | —Y— | —$(B)_q$— | —Z— | —$R_2$ |
|---|---|---|---|---|---|---|---|
| 1 | 1 | —H | — | —NHCONH— | — | — | —$(CH_2)_7CH_3$ |
| 2 | 1 | —H | — | —NHCONH— | — | — | —$(CH_2)_{13}CH_3$ |
| 3 | 1 | —H | — | —NHCONH— | — | — | —$(CH_2)_{17}CH_3$ |
| 4 | 2 | —H | — | —NHCONH— | — | — | —$(CH_2)_{15}CH_3$ |
| 5 | 2 | —H | — | —NHCONH— | — | — | —$(CH_2)_{17}CH_3$ |
| 6 | 2 | —H | — | —NHCONH— | — | — | —$(CH_2)_{21}CH_3$ |
| 7 | 3 | —H | — | —NHCONH— | — | — | —$(CH_2)_{15}CH_3$ |
| 8 | 3 | —H | — | —NHCONH— | — | — | —$(CH_2)_{17}CH_3$ |
| 9 | 2 | —$OCH_3$ | — | —NHCONH— | — | — | —$(CH_2)_{17}CH_3$ |
| 10 | 3 | —Cl | —$CH_2$— | —NHCONH— | — | — | —$(CH_2)_{17}CH_3$ |
| 11 | 1 | —H | — | —NHCONH— | —$(CH_2)_6$— | —O— | —$(CH_2)_{12}CH_3$ |
| 12 | 1 | —H | —$(CH_2)_2$— | —NHCONH— | —$(CH_2)_{12}$— | —O— | —$(CH_2)_{17}CH_3$ |
| 13 | 2 | —H | — | —NHCONH— | —$(CH_2)_4$— | —O— | —$(CH_2)_{17}CH_3$ |
| 14 | 2 | —H | —$(CH_2)_2$— | —NHCONH— | —$(CH_2)_6$— | —O— | —$(CH_2)_{17}CH_3$ |
| 15 | 3 | —Cl | — | —NHCONH— | —$(CH_2)_6$— | —O— | —$(CH_2)_{12}CH_3$ |
| 16 | 3 | —H | — | —NHCONH— | —$(CH_2)_{12}$— | —O— | —$(CH_2)_{17}CH_3$ |
| 17 | 1 | —H | —$CH_2$— | —NHCONH— | — | — | —$(CH_2)_{17}CH_3$ |
| 18 | 1 | —H | —$(CH_2)_2$— | —NHCONH— | — | — | —$(CH_2)_{17}CH_3$ |
| 19 | 2 | —H | —$(CH_2)_6$— | —NHCONH— | — | — | —$(CH_2)_{11}CH_3$ |

TABLE 1-2

| Compound No. | n | —R¹ | —(A)$_p$— | —Y— | —(B)$_q$— | —Z— | —R² |
|---|---|---|---|---|---|---|---|
| 20 | 1 | —H | — | —NHCONH— | p-phenylene | —O— | —$(CH_2)_{17}CH_3$ |
| 21 | 2 | —H | —$(CH_2)_6$— | —NHCONH— | p-phenylene | —O— | —$(CH_2)_{11}CH_3$ |
| 22 | 2 | —H | — | —NHCONH— | p-phenylene | —S— | —$(CH_2)_7CH_3$ |
| 23 | 1 | —H | — | —NHCONH— | p-phenylene | —CO— | —$(CH_2)_{17}CH_3$ |
| 24 | 3 | —H | — | —NHCONH— | p-phenylene | —NHCO— | —$(CH_2)_{17}CH_3$ |
| 25 | 1 | —H | — | —NHCONH— | p-phenylene | —CONH— | —$(CH_2)_{12}CH_3$ |
| 26 | 1 | —H | — | —NHCONH— | p-phenylene | —NHCONH— | —$(CH_2)_{19}CH_3$ |
| 27 | 2 | —H | — | —NHCONH— | p-phenylene | —NHCSNH— | —$(CH_2)_{17}CH_3$ |
| 28 | 1 | —H | — | —NHCONH— | p-phenylene | —OCO— | —$(CH_2)_{16}CH_3$ |
| 29 | 1 | —H | — | —NHCONH— | p-phenylene | —COO— | —$(CH_2)_{17}CH_3$ |
| 30 | 2 | —H | — | —NHCONH— | p-phenylene | —$SO_2$— | —$(CH_2)_{17}CH_3$ |
| 31 | 1 | —H | — | —NHCONH— | p-phenylene | —$SO_2NH$— | —$(CH_2)_{17}CH_3$ |
| 32 | 1 | —H | — | —NHCO— | — | — | —$(CH_2)_8CH_3$ |
| 33 | 1 | —H | — | —NHCO— | — | — | —$(CH_2)_{10}CH_3$ |
| 34 | 1 | —H | — | —NHCO— | — | — | —$(CH_2)_{16}CH_3$ |
| 35 | 2 | —H | — | —NHCO— | — | — | —$(CH_2)_{16}CH_3$ |
| 36 | 2 | —H | — | —NHCO— | — | — | —$(CH_2)_{12}CH_3$ |

TABLE 1-3

| Compound No. | n | —R¹ | —(A)$_p$— | —Y— | —(B)$_q$— | —Z— | —R$_2$ |
|---|---|---|---|---|---|---|---|
| 37 | 3 | —H | — | —NHCO— | — | — | —$(CH_2)_{10}CH_3$ |
| 38 | 3 | —H | — | —NHCO— | — | — | —$(CH_2)_{16}CH_3$ |
| 39 | 1 | —$OCH_3$ | — | —NHCO— | — | — | —$(CH_2)_{10}CH_3$ |
| 40 | 2 | —$CH_3$ | — | —NHCO— | — | — | —$(CH_2)_{16}CH_3$ |
| 41 | 3 | —OH | —$CH_2$— | —NHCO— | — | — | —$(CH_2)_{16}CH_3$ |
| 42 | 1 | —H | — | —NHCO— | —$(CH_2)_6$— | —O— | —$(CH_2)_{12}CH_3$ |
| 43 | 1 | —H | —$(CH_2)_2$— | —NHCO— | —$(CH_2)_6$— | —O— | —$(CH_2)_{11}CH_3$ |
| 44 | 2 | —H | — | —NHCO— | —$(CH_2)_6$— | —O— | —$(CH_2)_{11}CH_3$ |
| 45 | 2 | —H | —$(CH_2)_2$— | —NHCO— | —$(CH_2)_6$— | —O— | —$(CH_2)_{17}CH_3$ |
| 46 | 3 | —Cl | — | —NHCO— | —$(CH_2)_6$— | —O— | —$(CH_2)_{12}CH_3$ |
| 47 | 3 | —H | — | —NHCO— | —$(CH_2)_{12}$— | —O— | —$(CH_2)_{17}CH_3$ |
| 48 | 1 | —H | —$CH_2$— | —NHCO— | — | — | —$(CH_2)_{12}CH_3$ |
| 49 | 1 | —H | —$(CH_2)_2$— | —NHCO— | — | — | —$(CH_2)_{16}CH_3$ |
| 50 | 2 | —H | —$(CH_2)_6$— | —NHCO— | — | — | —$(CH_2)_{10}CH_3$ |
| 51 | 1 | —H | — | —NHCO— | p-phenylene | —O— | —$(CH_2)_{17}CH_3$ |
| 52 | 2 | —H | —$(CH_2)_6$— | —NHCO— | p-phenylene | —O— | —$(CH_2)_{11}CH_3$ |

TABLE 1-4

| Compound No. | n | —R¹ | —(A)$_p$— | —Y— | —(B)$_q$— | —Z— | —R² |
|---|---|---|---|---|---|---|---|
| 53 | 2 | —H | — | —NHCO— | p-phenylene | —S— | —$(CH_2)_7CH_3$ |
| 54 | 1 | —H | — | —NHCO— | p-phenylene | —CO— | —$(CH_2)_{16}CH_3$ |
| 55 | 3 | —H | — | —NHCO— | p-phenylene | —NHCO— | —$(CH_2)_{16}CH_3$ |
| 56 | 1 | —H | — | —NHCO— | p-phenylene | —CONH— | —$(CH_2)_{12}CH_3$ |
| 57 | 1 | —H | — | —NHCO— | p-phenylene | —NHCONH— | —$(CH_2)_{19}CH_3$ |
| 58 | 2 | —H | — | —NHCO— | p-phenylene | —NHCSNH— | —$(CH_2)_{17}CH_3$ |
| 59 | 1 | —H | — | —NHCO— | p-phenylene | —OCO— | —$(CH_2)_{16}CH_3$ |
| 60 | 1 | —H | — | —NHCO— | p-phenylene | —COO— | —$(CH_2)_{17}CH_3$ |
| 61 | 2 | —H | — | —NHCO— | p-phenylene | —$SO_2$— | —$(CH_2)_{17}CH_3$ |
| 62 | 1 | —H | — | —NHCO— | p-phenylene | —$SO_2NH$— | —$(CH_2)_{17}CH_3$ |
| 63 | 1 | —H | — | —CONH— | — | — | —$(CH_2)_7CH_3$ |
| 64 | 1 | —H | — | —CONH— | — | — | —$(CH_2)_{12}CH_3$ |
| 65 | 1 | —H | — | —CONH— | — | — | —$(CH_2)_{17}CH_3$ |
| 66 | 2 | —H | — | —CONH— | — | — | —$(CH_2)_{17}CH_3$ |
| 67 | 2 | —H | — | —CONH— | — | — | —$(CH_2)_{19}CH_3$ |
| 68 | 3 | —H | — | —CONH— | — | — | —$(CH_2)_{11}CH_3$ |
| 69 | 3 | —H | — | —CONH— | — | — | —$(CH_2)_{17}CH_3$ |
| 70 | 1 | —$OCH_3$ | — | —CONH— | — | — | —$(CH_2)_{11}CH_3$ |
| 71 | 2 | —$CH_3$ | — | —CONH— | — | — | —$(CH_2)_{17}CH_3$ |
| 72 | 3 | —Cl | —$CH_2$— | —CONH— | — | — | —$(CH_2)_{17}CH_3$ |

TABLE 1-5

| Compound No. | n | —R¹ | —(A)$_p$— | —Y— | —(B)$_q$— | —Z— | —R² |
|---|---|---|---|---|---|---|---|
| 73 | 1 | —H | — | —CONH— | —$(CH_2)_6$— | —O— | —$(CH_2)_{12}CH_3$ |
| 74 | 1 | —H | —$(CH_2)_2$— | —CONH— | —$(CH_2)_6$— | —O— | —$(CH_2)_{11}CH_3$ |

TABLE 1-5-continued

| Compound No. | n | —R¹ | —(A)$_p$— | —Y— | —(B)$_q$— | —Z— | —R² |
|---|---|---|---|---|---|---|---|
| 75 | 2 | —H | — | —CONH— | —$(CH_2)_6$— | —O— | —$(CH_2)_{11}CH_3$ |
| 76 | 2 | —H | —$(CH_2)_2$— | —CONH— | —$(CH_2)_6$— | —O— | —$(CH_2)_{17}CH_3$ |
| 77 | 3 | —Cl | — | —CONH— | —$(CH_2)_6$— | —O— | —$(CH_2)_{12}CH_3$ |
| 78 | 3 | —H | — | —CONH— | —$(CH_2)_{12}$— | —O— | —$(CH_2)_{17}CH_3$ |
| 79 | 1 | —H | —$CH_2$— | —CONH— | — | — | —$(CH_2)_{19}CH_3$ |
| 80 | 1 | —H | —$(CH_2)_2$— | —CONH— | — | — | —$(CH_2)_{17}CH_3$ |
| 81 | 2 | —H | —$(CH_2)_6$— | —CONH— | — | — | —$(CH_2)_{11}CH_3$ |
| 82 | 1 | —H | — | —CONH— | p-phenylene | —O— | —$(CH_2)_{17}CH_3$ |
| 83 | 2 | —H | —$(CH_2)_6$— | —CONH— | p-phenylene | —O— | —$(CH_2)_{11}CH_3$ |
| 84 | 2 | —H | — | —CONH— | p-phenylene | —S— | —$(CH_2)_7CH_3$ |
| 85 | 1 | —H | — | —CONH— | p-phenylene | —CO— | —$(CH_2)_{16}CH_3$ |
| 86 | 3 | —H | — | —CONH— | p-phenylene | —NHCO— | —$(CH_2)_{16}CH_3$ |
| 87 | 1 | —H | — | —CONH— | p-phenylene | —CONH— | —$(CH_2)_{12}CH_3$ |
| 88 | 1 | —H | — | —CONH— | p-phenylene | —NHCONH— | —$(CH_2)_{19}CH_3$ |

TABLE 1-6

| Compound No. | n | —R¹ | —(A)$_p$— | —Y— | —(B)$_q$— | —Z— | —R² |
|---|---|---|---|---|---|---|---|
| 89 | 2 | —H | — | —CONH— | p-phenylene | —NHCSNH— | —$(CH_2)_{17}CH_3$ |
| 90 | 1 | —H | — | —CONH— | p-phenylene | —OCO— | —$(CH_2)_{16}CH_3$ |
| 91 | 1 | —H | — | —CONH— | p-phenylene | —COO— | —$(CH_2)_{17}CH_3$ |
| 92 | 2 | —H | — | —CONH— | p-phenylene | —$SO_2$— | —$(CH_2)_{17}CH_3$ |
| 93 | 1 | —H | — | —CONH— | p-phenylene | —$SO_2NH$— | —$(CH_2)_{17}CH_3$ |
| 94 | 1 | —H | — | —NHSCNH— | — | — | —$(CH_2)_7CH_3$ |
| 95 | 1 | —H | — | —NHSCNH— | — | — | —$(CH_2)_{12}CH_3$ |
| 96 | 2 | —H | — | —NHSCNH— | — | — | —$(CH_2)_{17}CH_3$ |
| 97 | 2 | —H | — | —NHSCNH— | — | — | —$(CH_2)_{21}CH_3$ |
| 98 | 3 | —H | — | —NHSCNH— | — | — | —$(CH_2)_{11}CH_3$ |
| 99 | 3 | —H | — | —NHSCNH— | — | — | —$(CH_2)_{17}CH_3$ |
| 100 | 1 | —$CH_3$ | — | —NHSCNH— | — | — | —$(CH_2)_{11}CH_3$ |
| 101 | 2 | —$OCH_3$ | — | —NHSCNH— | — | — | —$(CH_2)_{17}CH_3$ |
| 102 | 3 | —Cl | —$CH_2$— | —NHSCNH— | — | — | —$(CH_2)_{17}CH_3$ |
| 103 | 1 | —H | — | —NHSCNH— | —$(CH_2)_6$— | —O— | —$(CH_2)_{12}CH_3$ |
| 104 | 1 | —H | —$(CH_2)_2$— | —NHSCNH— | —$(CH_2)_{12}$— | —O— | —$(CH_2)_{17}CH_3$ |
| 105 | 2 | —H | — | —NHSCNH— | —$(CH_2)_4$— | —O— | —$(CH_2)_{17}CH_3$ |
| 106 | 2 | —H | —$(CH_2)_2$— | —NHSCNH— | —$(CH_2)_6$— | —O— | —$(CH_2)_{17}CH_3$ |
| 107 | 3 | —Cl | — | —NHSCNH— | —$(CH_2)_6$— | —O— | —$(CH_2)_{12}CH_3$ |
| 108 | 3 | —H | — | —NHSCNH— | —$(CH_2)_{12}$— | —O— | —$(CH_2)_{17}CH_3$ |

TABLE 1-7

| Compound No. | n | —R¹ | —(A)$_p$— | —Y— | —(B)$_q$— | —Z— | —R² |
|---|---|---|---|---|---|---|---|
| 109 | 1 | —H | —$CH_2$— | —NHSCNH— | — | — | —$(CH_2)_{17}CH_3$ |
| 110 | 1 | —H | —$(CH_2)_2$— | —NHSCNH— | — | — | —$(CH_2)_{17}CH_3$ |
| 111 | 2 | —H | —$(CH_2)_6$— | —NHSCNH— | — | — | —$(CH_2)_{11}CH_3$ |
| 112 | 1 | —H | — | —NHSCNH— | p-phenylene | —O— | —$(CH_2)_{17}CH_3$ |
| 113 | 2 | —H | —$(CH_2)_6$— | —NHSCNH— | p-phenylene | —O— | —$(CH_2)_{11}CH_3$ |
| 114 | 2 | —H | — | —NHSCNH— | p-phenylene | —S— | —$(CH_2)_7CH_3$ |
| 115 | 1 | —H | — | —NHSCNH— | p-phenylene | —CO— | —$(CH_2)_{16}CH_3$ |
| 116 | 3 | —H | — | —NHSCNH— | p-phenylene | —NHCO— | —$(CH_2)_{16}CH_3$ |
| 117 | 1 | —H | — | —NHSCNH— | p-phenylene | —CONH— | —$(CH_2)_{12}CH_3$ |
| 118 | 1 | —H | — | —NHSCNH— | p-phenylene | —NHCONH— | —$(CH_2)_{19}CH_3$ |
| 119 | 2 | —H | — | —NHSCNH— | p-phenylene | —NHCSNH— | —$(CH_2)_{17}CH_3$ |
| 120 | 1 | —H | — | —NHSCNH— | p-phenylene | —OCO— | —$(CH_2)_{16}CH_3$ |
| 121 | 1 | —H | — | —NHSCNH— | p-phenylene | —COO— | —$(CH_2)_{17}CH_3$ |
| 122 | 2 | —H | — | —NHSCNH— | p-phenylene | —$SO_2$— | —$(CH_2)_{17}CH_3$ |
| 123 | 1 | —H | — | —NHSCNH— | p-phenylene | —$SO_2NH$— | —$(CH_2)_{17}CH_3$ |
| 124 | 1 | —H | — | —OCONH— | — | — | —$(CH_2)_7CH_3$ |

TABLE 1-8

| Compound No. | n | —R¹ | —(A)$_p$— | —Y— | —(B)$_q$— | —Z— | —$R_2$ |
|---|---|---|---|---|---|---|---|
| 125 | 1 | —H | — | —OCONH— | — | — | —$(CH_2)_{12}CH_3$ |
| 126 | 1 | —H | — | —OCONH— | — | — | —$(CH_2)_{17}CH_3$ |
| 127 | 2 | —H | — | —OCONH— | — | — | —$(CH_2)_{17}CH_3$ |
| 128 | 2 | —H | — | —OCONH— | — | — | —$(CH_2)_{21}CH_3$ |
| 129 | 3 | —H | — | —OCONH— | — | — | —$(CH_2)_{11}CH_3$ |

TABLE 1-8-continued

| Compound No. | n | —R¹ | —(A)$_p$— | —Y— | —(B)$_q$— | —Z— | —R$_2$ |
|---|---|---|---|---|---|---|---|
| 130 | 3 | —H | — | —OCONH— | — | — | —$(CH_2)_{17}CH_3$ |
| 131 | 1 | —$CH_3$ | — | —OCONH— | — | — | —$(CH_2)_{11}CH_3$ |
| 132 | 2 | —$OCH_3$ | — | —OCONH— | — | — | —$(CH_2)_{17}CH_3$ |
| 133 | 3 | —Cl | —$CH_2$— | —OCONH— | — | — | —$(CH_2)_{17}CH_3$ |
| 134 | 1 | —H | — | —OCONH— | —$(CH_2)_6$— | —O— | —$(CH_2)_{12}CH_3$ |
| 135 | 1 | —H | —$(CH_2)_2$— | —OCONH— | —$(CH_2)_{12}$— | —O— | —$(CH_2)_{17}CH_3$ |
| 136 | 2 | —H | — | —OCONH— | —$(CH_2)_4$— | —O— | —$(CH_2)_{17}CH_3$ |
| 137 | 2 | —H | —$(CH_2)_2$— | —OCONH— | —$(CH_2)_6$— | —O— | —$(CH_2)_{17}CH_3$ |
| 138 | 3 | —Cl | — | —OCONH— | —$(CH_2)_6$— | —O— | —$(CH_2)_{12}CH_3$ |
| 139 | 3 | —H | — | —OCONH— | —$(CH_2)_{12}$— | —O— | —$(CH_2)_{17}CH_3$ |
| 140 | 1 | —H | —$CH_2$— | —OCONH— | — | — | —$(CH_2)_{17}CH_3$ |
| 141 | 1 | —H | —$(CH_2)_2$— | —OCONH— | — | — | —$(CH_2)_{17}CH_3$ |
| 142 | 2 | —H | —$(CH_2)_6$— | —OCONH— | — | — | —$(CH_2)_{11}CH_3$ |

TABLE 1-9

| Compound No. | n | —R¹ | —(A)$_p$— | —Y— | —(B)$_q$— | —Z— | —R² |
|---|---|---|---|---|---|---|---|
| 143 | 1 | —H | — | —OCONH— | p-phenylene | —O— | —$(CH_2)_{17}CH_3$ |
| 144 | 2 | —H | —$(CH_2)_6$— | —OCONH— | p-phenylene | —O— | —$(CH_2)_{11}CH_3$ |
| 145 | 2 | —H | — | —OCONH— | p-phenylene | —S— | —$(CH_2)_7CH_3$ |
| 146 | 1 | —H | — | —OCONH— | p-phenylene | —CO— | —$(CH_2)_{16}CH_3$ |
| 147 | 3 | —H | — | —OCONH— | p-phenylene | —NHCO— | —$(CH_2)_{16}CH_3$ |
| 148 | 1 | —H | — | —OCONH— | p-phenylene | —CONH— | —$(CH_2)_{12}CH_3$ |
| 149 | 1 | —H | — | —OCONH— | p-phenylene | —NHCONH— | —$(CH_2)_{19}CH_3$ |
| 150 | 2 | —H | — | —OCONH— | p-phenylene | —NHCSNH— | —$(CH_2)_{17}CH_3$ |
| 151 | 1 | —H | — | —OCONH— | p-phenylene | —OCO— | —$(CH_2)_{16}CH_3$ |
| 152 | 1 | —H | — | —OCONH— | p-phenylene | —COO— | —$(CH_2)_{17}CH_3$ |
| 153 | 2 | —H | — | —OCONH— | p-phenylene | —$SO_2$— | —$(CH_2)_{17}CH_3$ |
| 154 | 1 | —H | — | —OCONH— | p-phenylene | —$SO_2NH$— | —$(CH_2)_{17}CH_3$ |
| 155 | 1 | —H | — | —OCO— | — | — | —$(CH_2)_{10}CH_3$ |
| 156 | 1 | —H | — | —OCO— | — | — | —$(CH_2)_{12}CH_3$ |
| 157 | 1 | —H | — | —OCO— | — | — | —$(CH_2)_{16}CH_3$ |
| 158 | 2 | —H | — | —OCO— | — | — | —$(CH_2)_{16}CH_3$ |
| 159 | 2 | —H | — | —OCO— | — | — | —$(CH_2)_{10}CH_3$ |
| 160 | 3 | —H | — | —OCO— | — | — | —$(CH_2)_{12}CH_3$ |

TABLE 1-10

| Compound No. | n | —R¹ | —(A)$_p$— | —Y— | —(B)$_q$— | —Z— | —R$_2$ |
|---|---|---|---|---|---|---|---|
| 161 | 3 | —H | — | —OCO— | — | — | —$(CH_2)_{16}CH_3$ |
| 162 | 1 | —$OCH_3$ | — | —OCO— | — | — | —$(CH_2)_{10}CH_3$ |
| 163 | 2 | —$CH_3$ | — | —OCO— | — | — | —$(CH_2)_{16}CH_3$ |
| 164 | 3 | —OH | —$CH_2$— | —OCO— | — | — | —$(CH_2)_{16}CH_3$ |
| 165 | 1 | —H | — | —OCO— | —$(CH_2)_6$— | —O— | —$(CH_2)_{12}CH_3$ |
| 166 | 1 | —H | —$(CH_2)_2$— | —OCO— | —$(CH_2)_6$— | —O— | —$(CH_2)_{11}CH_3$ |
| 167 | 2 | —H | — | —OCO— | —$(CH_2)_6$— | —O— | —$(CH_2)_{11}CH_3$ |
| 168 | 2 | —H | —$(CH_2)_2$— | —OCO— | —$(CH_2)_6$— | —O— | —$(CH_2)_{17}CH_3$ |
| 169 | 3 | —Cl | — | —OCO— | —$(CH_2)_6$— | —O— | —$(CH_2)_{12}CH_3$ |
| 170 | 3 | —H | — | —OCO— | —$(CH_2)_{12}$— | —O— | —$(CH_2)_{17}CH_3$ |
| 171 | 1 | —H | —$CH_2$— | —OCO— | — | — | —$(CH_2)_{12}CH_3$ |
| 172 | 1 | —H | —$(CH_2)_2$— | —OCO— | — | — | —$(CH_2)_{16}CH_3$ |
| 173 | 2 | —H | —$(CH_2)_6$— | —OCO— | — | — | —$(CH_2)_{10}CH_3$ |
| 174 | 1 | —H | — | —OCO— | p-phenylene | —O— | —$(CH_2)_{17}CH_3$ |
| 175 | 2 | —H | —$(CH_2)_6$— | —OCO— | p-phenylene | —O— | —$(CH_2)_{11}CH_3$ |
| 176 | 2 | —H | — | —OCO— | p-phenylene | —S— | —$(CH_2)_7CH_3$ |

TABLE 1-11

| Compound No. | n | —R¹ | —(A)$_p$— | —Y— | —(B)$_q$— | —Z— | —R$_2$ |
|---|---|---|---|---|---|---|---|
| 177 | 1 | —H | — | —OCO— | p-phenylene | —CO— | —$(CH_2)_{16}CH_3$ |
| 178 | 3 | —H | — | —OCO— | p-phenylene | —NHCO— | —$(CH_2)_{16}CH_3$ |
| 179 | 1 | —H | — | —OCO— | p-phenylene | —CONH— | —$(CH_2)_{12}CH_3$ |
| 180 | 1 | —H | — | —OCO— | p-phenylene | —NHCONH— | —$(CH_2)_{19}CH_3$ |
| 181 | 2 | —H | — | —OCO— | p-phenylene | —NHCSNH— | —$(CH_2)_{17}CH_3$ |
| 182 | 1 | —H | — | —OCO— | p-phenylene | —OCO— | —$(CH_2)_{14}CH_3$ |
| 183 | 1 | —H | — | —OCO— | p-phenylene | —COO— | —$(CH_2)_{17}CH_3$ |
| 184 | 2 | —H | — | —OCO— | p-phenylene | —$SO_2$— | —$(CH_2)_{17}CH_3$ |

TABLE 1-11-continued

| Compound No. | n | —R¹ | —(A)$_p$— | —Y— | —(B)$_q$— | —Z— | —R$_2$ |
|---|---|---|---|---|---|---|---|
| 185 | 1 | —H | — | —OCO— | p-phenylene | —$SO_2NH$— | —$(CH_2)_{17}CH_3$ |
| 186 | 1 | —H | — | —COO— | — | — | —$(CH_2)_7CH_3$ |
| 187 | 1 | —H | — | —COO— | — | — | —$(CH_2)_{12}CH_3$ |
| 188 | 1 | —H | — | —COO— | — | — | —$(CH_2)_{17}CH_3$ |
| 189 | 2 | —H | — | —COO— | — | — | —$(CH_2)_{17}CH_3$ |
| 190 | 2 | —H | — | —COO— | — | — | —$(CH_2)_{19}CH_3$ |
| 191 | 3 | —H | — | —COO— | — | — | —$(CH_2)_{11}CH_3$ |
| 192 | 3 | —H | — | —COO— | — | — | —$(CH_2)_{17}CH_3$ |
| 193 | 1 | —$OCH_3$ | — | —COO— | — | — | —$(CH_2)_{11}CH_3$ |
| 194 | 2 | —$CH_3$ | — | —COO— | — | — | —$(CH_2)_{17}CH_3$ |
| 195 | 3 | —Cl | —$CH_2$— | —COO— | — | — | —$(CH_2)_{17}CH_3$ |
| 196 | 1 | —H | — | —COO— | —$(CH_2)_6$— | —O— | —$(CH_2)_{12}CH_3$ |

TABLE 1-12

| Compound No. | n | —R¹ | —(A)$_p$— | —Y— | —(B)$_q$— | —Z— | —R² |
|---|---|---|---|---|---|---|---|
| 197 | 1 | —H | —$(CH_2)_2$— | —COO— | —$(CH_2)_6$— | —O— | —$(CH_2)_{11}CH_3$ |
| 198 | 2 | —H | — | —COO— | —$(CH_2)_6$— | —O— | —$(CH_2)_{11}CH_3$ |
| 199 | 2 | —H | —$(CH_2)_2$— | —COO— | —$(CH_2)_6$— | —O— | —$(CH_2)_{17}CH_3$ |
| 200 | 3 | —Cl | — | —COO— | —$(CH_2)_6$— | —O— | —$(CH_2)_{12}CH_3$ |
| 201 | 3 | —H | — | —COO— | —$(CH_2)_{12}$— | —O— | —$(CH_2)_{17}CH_3$ |
| 202 | 1 | —H | —$CH_2$— | —COO— | — | — | —$(CH_2)_{19}CH_3$ |
| 203 | 1 | —H | —$(CH_2)_2$— | —COO— | — | — | —$(CH_2)_{17}CH_3$ |
| 204 | 2 | —H | —$(CH_2)_6$— | —COO— | — | — | —$(CH_2)_{11}CH_3$ |
| 205 | 1 | —H | — | —COO— | p-phenylene | —O— | —$(CH_2)_{17}CH_3$ |
| 206 | 2 | —H | —$(CH_2)_6$— | —COO— | p-phenylene | —O— | —$(CH_2)_{11}CH_3$ |
| 207 | 2 | —H | — | —COO— | p-phenylene | —S— | —$(CH_2)_7CH_3$ |
| 208 | 1 | —H | — | —COO— | p-phenylene | —CO— | —$(CH_2)_{14}CH_3$ |
| 209 | 3 | —H | — | —COO— | p-phenylene | —NHCO— | —$(CH_2)_{16}CH_3$ |
| 210 | 1 | —H | — | —COO— | p-phenylene | —CONH— | —$(CH_2)_{12}CH_3$ |
| 211 | 1 | —H | — | —COO— | p-phenylene | —NHCONH— | —$(CH_2)_{19}CH_3$ |
| 212 | 2 | —H | — | —COO— | p-phenylene | —NHCSNH— | —$(CH_2)_{17}CH_3$ |

TABLE 1-13

| Compound No. | n | —R¹ | —(A)$_p$— | —Y— | —(B)$_q$— | —Z— | —R$_2$ |
|---|---|---|---|---|---|---|---|
| 213 | 1 | —H | — | —COO— | p-phenylene | —OCO— | —$(CH_2)_{14}CH_3$ |
| 214 | 1 | —H | — | —COO— | p-phenylene | —COO— | —$(CH_2)_{17}CH_3$ |
| 215 | 2 | —H | — | —COO— | p-phenylene | —$SO_2$— | —$(CH_2)_{17}CH_3$ |
| 216 | 1 | —H | — | —COO— | p-phenylene | —$SO_2NH$— | —$(CH_2)_{17}CH_3$ |
| 217 | 1 | —H | — | —O— | — | — | —$(CH_2)_7CH_3$ |
| 218 | 1 | —H | — | —O— | — | — | —$(CH_2)_{12}CH_3$ |
| 219 | 1 | —H | — | —O— | — | — | —$(CH_2)_{17}CH_3$ |
| 220 | 2 | —H | — | —O— | — | — | —$(CH_2)_{17}CH_3$ |
| 221 | 2 | —H | — | —O— | — | — | —$(CH_2)_{21}CH_3$ |
| 222 | 3 | —H | — | —O— | — | — | —$(CH_2)_{11}CH_3$ |
| 223 | 3 | —H | — | —O— | — | — | —$(CH_2)_{17}CH_3$ |
| 224 | 1 | —$OCH_3$ | — | —O— | — | — | —$(CH_2)_{11}CH_3$ |
| 225 | 2 | —$CH_3$ | — | —O— | — | — | —$(CH_2)_{17}CH_3$ |
| 226 | 3 | —Cl | —$CH_2$— | —O— | — | — | —$(CH_2)_{17}CH_3$ |
| 227 | 1 | —H | — | —O— | —$(CH_2)_6$— | —O— | —$(CH_2)_{12}CH_3$ |
| 228 | 1 | —H | —$(CH_2)_4$— | —O— | —$(CH_2)_4$— | —S— | —$(CH_2)_{12}CH_3$ |
| 229 | 2 | —H | — | —O— | —$(CH_2)_4$— | —O— | —$(CH_2)_{17}CH_3$ |
| 230 | 2 | —H | —$(CH_2)_2$— | —O— | —$(CH_2)_6$— | —S— | —$(CH_2)_{17}CH_3$ |
| 231 | 3 | —Cl | — | —O— | —$(CH_2)_{12}$— | —O— | —$(CH_2)_{12}CH_3$ |
| 232 | 3 | —H | — | —O— | —$(CH_2)_{12}$— | —O— | —$(CH_2)_{17}CH_3$ |

TABLE 1-14

| Compound No. | n | —R¹ | —(A)$_p$— | —Y— | —(B)$_q$— | —Z— | —R² |
|---|---|---|---|---|---|---|---|
| 233 | 1 | —H | —$CH_2$— | —O— | — | — | —$(CH_2)_{17}CH_3$ |
| 234 | 1 | —H | —$(CH_2)_2$— | —O— | — | — | —$(CH_2)_{17}CH_3$ |
| 235 | 2 | —H | —$(CH_2)_6$— | —O— | — | — | —$(CH_2)_{11}CH_3$ |
| 236 | 1 | —H | — | —O— | p-phenylene | —S— | —$(CH_2)_{17}CH_3$ |
| 237 | 1 | —H | — | —O— | p-phenylene | —O— | —$(CH_2)_{17}CH_3$ |
| 238 | 2 | —H | —$(CH_2)_6$— | —O— | p-phenylene | —O— | —$(CH_2)_{17}CH_3$ |
| 239 | 2 | —H | — | —O— | p-phenylene | —S— | —$(CH_2)_7CH_3$ |

TABLE 1-14-continued

| Compound No. | n | —R¹ | —(A)$_p$— | —Y— | —(B)$_q$— | —Z— | —R² |
|---|---|---|---|---|---|---|---|
| 240 | 1 | —H | — | —O— | p-phenylene | —CO— | —$(CH_2)_{16}CH_3$ |
| 241 | 3 | —H | — | —O— | p-phenylene | —NHCO— | —$(CH_2)_{16}CH_3$ |
| 242 | 1 | —H | — | —O— | p-phenylene | —CONH— | —$(CH_2)_{11}CH_3$ |
| 243 | 1 | —H | — | —O— | p-phenylene | —NHCONH— | —$(CH_2)_{17}CH_3$ |
| 244 | 2 | —H | — | —O— | p-phenylene | —NHCSNH— | —$(CH_2)_{17}CH_3$ |
| 245 | 1 | —H | — | —O— | p-phenylene | —OCO— | —$(CH_2)_{16}CH_3$ |
| 246 | 1 | —H | — | —O— | p-phenylene | —COO— | —$(CH_2)_{17}CH_3$ |
| 247 | 2 | —H | — | —O— | p-phenylene | —$SO_2$— | —$(CH_2)_{17}CH_3$ |
| 248 | 1 | —H | — | —O— | p-phenylene | —OCONH— | —$(CH_2)_{17}CH_3$ |
| 249 | 1 | —H | — | —S— | — | — | —$(CH_2)_7CH_3$ |

TABLE 1-15

| Compound No. | n | —R¹ | —(A)$_p$— | —Y— | —(B)$_q$— | —Z— | —R² |
|---|---|---|---|---|---|---|---|
| 250 | 1 | —H | — | —S— | — | — | —$(CH_2)_{12}CH_3$ |
| 251 | 1 | —H | — | —S— | — | — | —$(CH_2)_{17}CH_3$ |
| 252 | 2 | —H | — | —S— | — | — | —$(CH_2)_{17}CH_3$ |
| 253 | 2 | —H | — | —S— | — | — | —$(CH_2)_{21}CH_3$ |
| 254 | 3 | —H | — | —S— | — | — | —$(CH_2)_{11}CH_3$ |
| 255 | 3 | —H | — | —S— | — | — | —$(CH_2)_{17}CH_3$ |
| 256 | 1 | —$OCH_3$ | — | —S— | — | — | —$(CH_2)_{11}CH_3$ |
| 257 | 2 | —$CH_3$ | — | —S— | — | — | —$(CH_2)_{17}CH_3$ |
| 258 | 3 | —Cl | —$CH_2$— | —S— | — | — | —$(CH_2)_{17}CH_3$ |
| 259 | 1 | —H | — | —S— | —$(CH_2)_6$— | —S— | —$(CH_2)_{12}CH_3$ |
| 260 | 1 | —H | —$(CH_2)_4$— | —S— | —$(CH_2)_4$— | —S— | —$(CH_2)_{12}CH_3$ |
| 261 | 1 | —H | — | —S— | —$(CH_2)_4$— | —O— | —$(CH_2)_{17}CH_3$ |
| 262 | 2 | —H | —$(CH_2)_2$— | —S— | —$(CH_2)_6$— | —S— | —$(CH_2)_{17}CH_3$ |
| 263 | 3 | —Cl | — | —S— | —$(CH_2)_{12}$— | —O— | —$(CH_2)_{12}CH_3$ |
| 264 | 3 | —H | — | —S— | —$(CH_2)_{12}$— | —O— | —$(CH_2)_{17}CH_3$ |
| 265 | 1 | —H | —$CH_2$— | —S— | — | — | —$(CH_2)_{17}CH_3$ |
| 266 | 1 | —H | —$(CH_2)_2$— | —S— | — | — | —$(CH_2)_{17}CH_3$ |
| 267 | 2 | —H | —$(CH_2)_6$— | —S— | — | — | —$(CH_2)_{11}CH_3$ |

TABLE 1-16

| Compound No. | n | —R¹ | —(A)$_p$— | —Y— | —(B)$_q$— | —Z— | —R² |
|---|---|---|---|---|---|---|---|
| 268 | 1 | —H | — | —S— | p-phenylene | —S— | —$(CH_2)_{17}CH_3$ |
| 269 | 1 | —H | — | —S— | p-phenylene | —O— | —$(CH_2)_{17}CH_3$ |
| 270 | 2 | —H | —$(CH_2)_6$— | —S— | p-phenylene | —O— | —$(CH_2)_{17}CH_3$ |
| 271 | 2 | —H | — | —S— | p-phenylene | —S— | —$(CH_2)_7CH_3$ |
| 272 | 1 | —H | — | —S— | p-phenylene | —CO— | —$(CH_2)_{16}H_3$ |
| 273 | 3 | —H | — | —S— | p-phenylene | —NHCO— | —$(CH_2)_{14}H_3$ |
| 274 | 1 | —H | — | —S— | p-phenylene | —CONH— | —$(CH_2)_{11}CH_3$ |
| 275 | 1 | —H | — | —S— | p-phenylene | —NHCONH— | —$(CH_2)_{17}CH_3$ |
| 276 | 2 | —H | — | —S— | p-phenylene | —NHCSNH— | —$(CH_2)_{17}CH_3$ |
| 277 | 1 | —H | — | —S— | p-phenylene | —OCO— | —$(CH_2)_{16}CH_3$ |
| 278 | 1 | —H | — | —S— | p-phenylene | —COO— | —$(CH_2)_{17}CH_3$ |
| 279 | 2 | —H | — | —S— | p-phenylene | —$SO_2$— | —$(CH_2)_{17}CH_3$ |
| 280 | 1 | —H | — | —S— | p-phenylene | —OCONH— | —$(CH_2)_{17}CH_3$ |
| 281 | 1 | —H | — | —$SO_2$— | — | — | —$(CH_2)_7CH_3$ |
| 282 | 1 | —H | — | —$SO_2$— | — | — | —$(CH_2)_{12}CH_3$ |
| 283 | 1 | —H | — | —$SO_2$— | — | — | —$(CH_2)_{17}CH_3$ |
| 284 | 2 | —H | — | —$SO_2$— | — | — | —$(CH_2)_{17}CH_3$ |
| 285 | 2 | —H | — | —$SO_2$— | — | — | —$(CH_2)_{21}CH_3$ |
| 286 | 3 | —H | — | —$SO_2$— | — | — | —$(CH_2)_{11}CH_3$ |

TABLE 1-17

| Compound No. | n | —R¹ | —(A)$_p$— | —Y— | —(B)$_q$— | —Z— | —R$_2$ |
|---|---|---|---|---|---|---|---|
| 287 | 3 | —H | — | —$SO_2$— | — | — | —$(CH_2)_{17}CH_3$ |
| 288 | 1 | —$OCH_3$ | — | —$SO_2$— | — | — | —$(CH_2)_{11}CH_3$ |
| 289 | 2 | —$CH_3$ | — | —$SO_2$— | — | — | —$(CH_2)_{17}CH_3$ |
| 290 | 3 | —Cl | —$CH_2$— | —$SO_2$— | — | — | —$(CH_2)_{17}CH_3$ |
| 291 | 1 | —H | — | —$SO_2$— | —$(CH_2)_6$— | —S— | —$(CH_2)_{12}CH_3$ |
| 292 | 1 | —H | —$(CH_2)_4$— | —$SO_2$— | —$(CH_2)_4$— | —S— | —$(CH_2)_{12}CH_3$ |
| 293 | 2 | —H | — | —$SO_2$— | —$(CH_2)_4$— | —O— | —$(CH_2)_{17}CH_3$ |
| 294 | 2 | —H | —$(CH_2)_2$— | —$SO_2$— | —$(CH_2)_6$— | —S— | —$(CH_2)_{17}CH_3$ |

TABLE 1-17-continued

| Compound No. | n | —R¹ | —(A)$_p$— | —Y— | —(B)$_q$— | —Z— | —R$_2$ |
|---|---|---|---|---|---|---|---|
| 295 | 3 | —Cl | — | —$SO_2$— | —$(CH_2)_{12}$— | —O— | —$(CH_2)_{12}CH_3$ |
| 296 | 3 | —H | — | —$SO_2$— | —$(CH_2)_{12}$— | —O— | —$(CH_2)_{17}CH_3$ |
| 297 | 1 | —H | —$CH_2$— | —$SO_2$— | — | — | —$(CH_2)_{17}CH_3$ |
| 298 | 1 | —H | —$(CH_2)_2$— | —$SO_2$— | — | — | —$(CH_2)_{17}CH_3$ |
| 299 | 2 | —H | —$(CH_2)_6$— | —$SO_2$— | — | — | —$(CH_2)_{11}CH_3$ |
| 300 | 1 | —H | — | —$SO_2$— | p-phenylene | —S— | —$(CH_2)_{17}CH_3$ |
| 301 | 1 | —H | — | —$SO_2$— | p-phenylene | —O— | —$(CH_2)_{17}CH_3$ |
| 302 | 2 | —H | —$(CH_2)_6$— | —$SO_2$— | p-phenylene | —O— | —$(CH_2)_{17}CH_3$ |
| 303 | 2 | —H | — | —$SO_2$— | p-phenylene | —S— | —$(CH_2)_7CH_3$ |

TABLE 1-18

| Compound No. | n | —R¹ | —(A)$_p$— | —Y— | —(B)$_q$— | —Z— | —R² |
|---|---|---|---|---|---|---|---|
| 304 | 1 | —H | — | —$SO_2$— | p-phenylene | —CO— | —$(CH_2)_{16}H_3$ |
| 305 | 3 | —H | — | —$SO_2$— | p-phenylene | —NHCO— | —$(CH_2)_{14}H_3$ |
| 306 | 1 | —H | — | —$SO_2$— | p-phenylene | —CONH— | —$(CH_2)_{11}CH_3$ |
| 307 | 1 | —H | — | —$SO_2$— | p-phenylene | —NHCONH— | —$(CH_2)_{17}CH_3$ |
| 308 | 2 | —H | — | —$SO_2$— | p-phenylene | —NHCSNH— | —$(CH_2)_{17}CH_3$ |
| 309 | 1 | —H | — | —$SO_2$— | p-phenylene | —OCO— | —$(CH_2)_{16}CH_3$ |
| 310 | 1 | —H | — | —$SO_2$— | p-phenylene | —COO— | —$(CH_2)_{17}CH_3$ |
| 311 | 2 | —H | — | —$SO_2$— | p-phenylene | —$SO_2$— | —$(CH_2)_{17}CH_3$ |
| 312 | 1 | —H | — | —$SO_2$— | p-phenylene | —OCONH— | —$(CH_2)_{17}CH_3$ |
| 313 | 1 | —H | — | —$SO_2NH$— | — | — | —$(CH_2)_7CH_3$ |
| 314 | 1 | —H | — | —$SO_2NH$— | — | — | —$(CH_2)_{12}CH_3$ |
| 315 | 1 | —H | — | —$SO_2NH$— | — | — | —$(CH_2)_{17}CH_3$ |
| 316 | 2 | —H | — | —$SO_2NH$— | — | — | —$(CH_2)_{17}CH_3$ |
| 317 | 2 | —H | — | —$SO_2NH$— | — | — | —$(CH_2)_{21}CH_3$ |
| 318 | 3 | —H | — | —$SO_2NH$— | — | — | —$(CH_2)_{11}CH_3$ |
| 319 | 3 | —H | — | —$SO_2NH$— | — | — | —$(CH_2)_{17}CH_3$ |
| 320 | 1 | —$OCH_3$ | — | —$SO_2NH$— | — | — | —$(CH_2)_{11}CH_3$ |
| 321 | 2 | —$CH_3$ | — | —$SO_2NH$— | — | — | —$(CH_2)_{17}CH_3$ |
| 322 | 3 | —Cl | —$CH_2$— | —$SO_2NH$— | — | — | —$(CH_2)_{17}CH_3$ |
| 323 | 1 | —H | — | —$SO_2NH$— | —$(CH_2)_6$— | —S— | —$(CH_2)_{12}CH_3$ |

TABLE 1-19

| Compound No. | n | —R¹ | —(A)$_p$— | —Y— | —(B)$_q$— | —Z— | —R² |
|---|---|---|---|---|---|---|---|
| 324 | 1 | —H | —$(CH_2)_4$— | —$SO_2NH$— | —$(CH_2)_4$— | —S— | —$(CH_2)_{12}CH_3$ |
| 325 | 2 | —H | — | —$SO_2NH$— | —$(CH_2)_4$— | —O— | —$(CH_2)_{17}CH_3$ |
| 326 | 2 | —H | —$(CH_2)_2$— | —$SO_2NH$— | —$(CH_2)_6$— | —S— | —$(CH_2)_{17}CH_3$ |
| 327 | 3 | —Cl | — | —$SO_2NH$— | —$(CH_2)_{12}$— | —O— | —$(CH_2)_{12}CH_3$ |
| 328 | 3 | —H | — | —$SO_2NH$— | —$(CH_2)_{12}$— | —O— | —$(CH_2)_{17}CH_3$ |
| 329 | 1 | —H | —$CH_2$— | —$SO_2NH$— | — | — | —$(CH_2)_{17}CH_3$ |
| 330 | 1 | —H | —$(CH_2)_2$—3 | —$SO_2NH$— | — | — | —$(CH_2)_{17}CH_3$ |
| 331 | 2 | —H | —$(CH_2)_6$— | —$SO_2NH$— | — | — | —$(CH_2)_{11}CH_3$ |
| 332 | 1 | —H | — | —$SO_2NH$— | p-phenylene | —S— | —$(CH_2)_{17}CH_3$ |
| 333 | 1 | —H | — | —$SO_2NH$— | p-phenylene | —O— | —$(CH_2)_{17}CH_3$ |
| 334 | 2 | —H | —$(CH_2)_6$— | —$SO_2NH_2$ | p-phenylene | —O— | —$(CH_2)_{17}CH_3$ |
| 335 | 2 | —H | — | —$SO_2NH$— | p-phenylene | —S— | —$(CH_2)_7CH_3$ |
| 336 | 1 | —H | — | —$SO_2NH$— | p-phenylene | —CO— | —$(CH_2)_{14}H_3$ |
| 337 | 3 | —H | — | —$SO_2NH$— | p-phenylene | —NHCO— | —$(CH_2)_{16}H_3$ |
| 338 | 1 | —H | — | —$SO_2NH$— | p-phenylene | —CONH— | —$(CH_2)_{11}CH_3$ |
| 339 | 1 | —H | — | —$SO_2NH$— | p-phenylene | —NHCONH— | —$(CH_2)_{17}CH_3$ |
| 340 | 2 | —H | — | —$SO_2NH$— | p-phenylene | —NHCSNH— | —$(CH_2)_{17}CH_3$ |

TABLE 1-20

| Compound No. | n | —R¹ | —(A)$_p$— | —Y— | —(B)$_q$— | —Z— | —R$_2$ |
|---|---|---|---|---|---|---|---|
| 341 | 1 | —H | — | —$SO_2NH$— | p-phenylene | —OCO— | —$(CH_2)_{14}CH_3$ |
| 342 | 1 | —H | — | —$SO_2NH$— | p-phenylene | —COO— | —$(CH_2)_{17}CH_3$ |
| 343 | 2 | —H | — | —$SO_2NH$— | p-phenylene | —$SO_2$— | —$(CH_2)_{17}CH_3$ |
| 344 | 1 | —H | — | —$SO_2NH$— | p-phenylene | —OCONH— | —$(CH_2)_{17}CH_3$ |
| 345 | 1 | —H | — | —CO— | — | — | —$(CH_2)_{10}CH_3$ |
| 346 | 1 | —H | — | —CO— | — | — | —$(CH_2)_{12}CH_3$ |
| 347 | 1 | —H | — | —CO— | — | — | —$(CH_2)_{16}CH_3$ |
| 348 | 2 | —H | — | —CO— | — | — | —$(CH_2)_{16}CH_3$ |
| 349 | 2 | —H | — | —CO— | — | — | —$(CH_2)_{20}CH_3$ |

TABLE 1-20-continued

| Compound No. | n | —R¹ | —(A)$_p$— | —Y— | —(B)$_q$— | —Z— | —R$_2$ |
|---|---|---|---|---|---|---|---|
| 350 | 3 | —H | — | —CO— | — | — | —$(CH_2)_{12}CH_3$ |
| 351 | 3 | —H | — | —CO— | — | — | —$(CH_2)_{16}CH_3$ |
| 352 | 1 | —$OCH_3$ | — | —CO— | — | — | —$(CH_2)_{10}CH_3$ |
| 353 | 2 | —$CH_3$ | — | —CO— | — | — | —$(CH_2)_{16}CH_3$ |
| 354 | 3 | —Cl | —$CH_2$— | —CO— | — | — | —$(CH_2)_{16}CH_3$ |
| 355 | 1 | —H | — | —CO— | —$(CH_2)_6$— | —S— | —$(CH_2)_{12}CH_3$ |
| 356 | 1 | —H | —$(CH_2)_4$— | —CO— | —$(CH_2)_4$— | —S— | —$(CH_2)_{12}CH_3$ |
| 357 | 2 | —H | — | —CO— | —$(CH_2)_4$— | —O— | —$(CH_2)_{17}CH_3$ |
| 358 | 2 | —H | —$(CH_2)_2$— | —CO— | —$(CH_2)_6$— | —S— | —$(CH_2)_{17}CH_3$ |
| 359 | 3 | —Cl | — | —CO— | —$(CH_2)_{12}$— | —O— | —$(CH_2)_{12}CH_3$ |
| 360 | 3 | —H | — | —CO— | —$(CH_2)_{12}$— | —O— | —$(CH_2)_{17}CH_3$ |

TABLE 1-21

| Compound No. | n | —R¹ | —(A)$_p$— | —Y— | —(B)$_q$— | —Z— | —R² |
|---|---|---|---|---|---|---|---|
| 361 | 1 | —H | —$CH_2$— | —CO— | — | — | —$(CH_2)_{16}CH_3$ |
| 362 | 1 | —H | —$(CH_2)_2$— | —CO— | — | — | —$(CH_2)_{16}CH_3$ |
| 363 | 2 | —H | —$(CH_2)_6$— | —CO— | — | — | —$(CH_2)_{10}CH_3$ |
| 364 | 1 | —H | — | —CO— | p-phenylene | —S— | —$(CH_2)_{17}CH_3$ |
| 365 | 1 | —H | — | —CO— | p-phenylene | —O— | —$(CH_2)_{17}CH_3$ |
| 366 | 2 | —H | —$(CH_2)_6$— | —CO— | p-phenylene | —O— | —$(CH_2)_{17}CH_3$ |
| 367 | 2 | —H | — | —CO— | p-phenylene | —S— | —$(CH_2)_7CH_3$ |
| 368 | 1 | —H | — | —CO— | p-phenylene | —CO— | —$(CH_2)_{16}H_3$ |
| 369 | 3 | —H | — | —CO— | p-phenylene | —NHCO— | —$(CH_2)_{16}H_3$ |
| 370 | 1 | —H | — | —CO— | p-phenylene | —CONH— | —$(CH_2)_{11}CH_3$ |
| 371 | 1 | —H | — | —CO— | p-phenylene | —NHCONH— | —$(CH_2)_{17}CH_3$ |
| 372 | 2 | —H | — | —CO— | p-phenylene | —NHCSNH— | —$(CH_2)_{17}CH_3$ |
| 373 | 1 | —H | — | —CO— | p-phenylene | —OCO— | —$(CH_2)_{14}CH_3$ |
| 374 | 1 | —H | — | —CO— | p-phenylene | —COO— | —$(CH_2)_{17}CH_3$ |
| 375 | 2 | —H | — | —CO— | p-phenylene | —$SO_2$— | —$(CH_2)_{17}CH_3$ |
| 376 | 1 | —H | — | —CO— | p-phenylene | —OCONH— | —$(CH_2)_{17}CH_3$ |

The coloring agent used in conjunction with the above developer is an electron donor compound capable of reacting with the developer when heated at a temperature at which the coloring agent and the developer are fused, thereby developing a color. Colorless or light colored dye precursors (leuco dyes) conventionally used in thermosensitive materials may be used as the coloring agent. Such leuco dyes may be, for example, phthalide compounds, azaphthalide compounds, fluoran compounds, phenothiazine compounds and leuco-auramine compounds. The coloring agent having the following general formula (II) or (III) may be particularly suitably used.

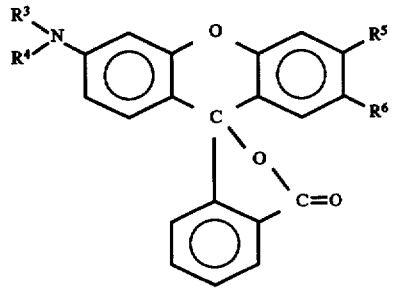

(II)

-continued

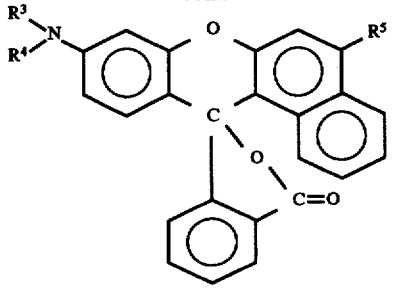

(III)

wherein $R^3$ stands for a hydrogen atom or an alkyl group having 1–4 carbon atoms, $R^4$ stands for an alkyl group having 1–6 carbon atoms, a cyclohexyl group or a substituted or unsubstituted phenyl group, $R^5$ stands for a hydrogen atom, an alkyl group having 1–2 carbon atoms, an alkoxy group or a halogen atom and $R^6$ stands for a hydrogen atom, a methyl group, a halogen atom or a substituted or unsubstituted amino group. Examples of the substituents of the phenyl group $R^4$ include an alkyl group such as a methyl group, an ethyl group or other lower alkyl group; an alkoxy group such as methoxy group or an ethoxy group; and a halogen atom. Examples of the substituents of the amino group $R^6$ include an alkyl group, a substituted or unsubstituted aryl group or a substituted or unsubstituted aralkyl group. Examples of the substituents of the aryl and aralkyl groups include an alkyl group, a halogen atom and an alkoxy group.

Illustrative of suitable coloring agents of the above formulas are as follows:

2-anilino-3-methyl-6-diethylaminofluoran,
2-anilino-3-methyl-6-(di-n-butylamino)fluoran,
2-anilino-3-methyl-6-(N-n-propyl-N-methylamino) fluoran,
2-anilino-3-methyl-6-(N-isopropyl-N-methylamino) fluoran,
2-anilino-3-methyl-6-(N-isobutyl-N-methylamino) fluoran,
2-anilino-3-methyl-6-(N-n-amyl-N-methylamino) fluoran,
2-anilino-3-methyl-6-(N-sec-buty-N-ethylamino)fluoran,
2-anilino-3-methyl-6-(N-n-amyl-N-ethylamino)fluoran,
2-anilino-3-methyl-6-(N-isoamyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trifluoromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino) fluoran,
2-(N-methyl-p-toluidino)-3-methyl-6-(N-propyl-p-toluidino)fluoran,
2-anilino-6-(N-n-hyxyl-N-ethylamino)fluorane,
2-(o-chloroanilino)-6-diethylaminofluoran,
2-(o-bromoanilino)-6-diethylaminofluoran,
2-(o-chloroanilino)-6-dibutylaminofluoran,
2-(o-bromoanilino)-6-dibutylaminofluoran,
2-(m-trifluoromethylanilino)-6-diethylaminofluoran,
2-(p-acetylanilino)-6-(N-n-amyl-N-n-butylamino) fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino) fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-methyl-N-cyclohexylamino)fluoran and
1,2-benzo-6-(N-ethyltoluidino)fluoran.

The following coloring agents may also be suitably used for the purpose of the present invention:

2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino) fluoran,
2-(α-phenylethylamino)-4-methyl-6-diethylaminofluoran,
2-(p-toluidino)-3-(t-butyl)-6-(N-methyl-p-toluidino) fluoran,
2-(o-methoxycarbonylanilino)-6-diethylaminofluoran, 2-acetylamino-6-(N-methyl-p-toluidino)fluoran, 3-diethylamino-6-(m-trifluoromethylanilino)fluoran, 4-methoxy-6-(N-ethyl-p-toluidino)fluoran, 2-ethoxyethylamino-3-chloro-6-dibutylaminofluoran, 2-dibenzylamino-4-chloro-6-(N-ethyl-p-toluidino) fluoran, 2-(α-phenylethylamino)-4-chloro-6-diethylaminofluoran, 2-(N-benzyl-p-trifluoromethylanilino)-4-chloro-6-diethylamino fluoran, 2-anilino-3-methyl-6-pyrolidinofluoran, 2-anilino-3-chloro-6-pyrolidinofluoran, 2-anilino-3-methyl-6-(N-ethyl-N-tetrahydrofurfurylamino)fluoran, 2-mesidino-4', 5'-benzo-6-diethylaminofluoran, 2-(m-trifluoromethylanilino)-3-methyl-6-pyrolidinofluoran, 2-(α-naphthylamino)-3,4-benzo-4'-bromo-6-(N-benzyl-N-cyclohexylamino)fluoran, 2-piperidino-6-diethylaminofluoran, 2-(N-n-propyl-p-trifluoromethylanilino)-6-morpholinofluoran, 2-(di-N-p-chlorophenylmethylamino)-6-pyrolidinofluoran, 2-(N-n-propyl-m-trifluoromethylanilino)-6-morpholinofluoran, 1,2-benzo-6-(N-ethyl-N-n-octylamino)fluoran, 1,2-benzo-6-diallylaminofluoran, 1,2-benzo-6-(N-ethoxyethyl-N-ethylamino)fluoran, benzoleuco methylene blue, 2-[3,6-bis(diethylamino)]-6-(o-chloroanilino)xanthyl benzoic acid lactam, 2-[3,6-bis(diethylamino)]-9-(o-chloroanilino)xanthyl benzoic acid lactam, 3,3-bis(p-dimethylaminophenyl)phthalide, 3,3-bis(p-dimethylaminophenyl)-6-dimethylaminophthalide, 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-(2-methoxy-4-dimethylaminophenyl)-3-(2-hydroxy-4,5-dichlorophenyl)phthalide, 3-(2-hydroxy-4-dimethylaminophenyl)-3-(2-methoxy-5-chlorophenyl)phthalide, 3-(2-hydroxy-4-dimethoxyaminophenyl)-3-(2-methoxy-5-chlorophenyl)phthalide, 3-(2-hydroxy-4-dimethylaminophenyl)-3-(2-methoxy-5-nitrophenyl)phthalide, 3-(2-hydroxy-4-diethylaminophenyl)-3-(2-methoxy-5-methylphenyl)phthalide, 3-(2-methoxy-4-dimethylaminophenyl)-3-(2-hydroxy-4-chloro-5-methoxyphenyl)phthalide, 3,6-bis(dimethylamino)fluorenespiro(9,3')-6'-dimethylaminophthalide, 3-(1-ethyl-2-methylindole-3-yl)-3-(2-ethoxy-4-diethylaminophenyl)-4-azaphthalide, 3-(1-octyl-2-methylindole-3-yl)-3-(2-ethoxy-4-diethylaminophenyl)-4-azaphthalide, 3-(1-ethyl-2-methylindole-3-yl)-3-(2-ethoxy-4-diethylaminophenyl)-7-azaphthalide, 3,3-bis(2-ethoxy-4-diethylaminophenyl)-4-azaphthalide, 3,3-bis(2-ethoxy-4-diethylaminophenyl)-7-azaphthalide, 6'-chloro-8'-methoxybenzoindolinospiropyran and 6'-bromo-2'-methoxybenzoindolinospiropyran.

In the thermosensitive recording layer, the molar ratio of the developer to the coloring agent is generally in the range from 0.1:1 to 20:1, preferably 0.2:1 to 10:1 for reasons of obtaining satisfactory image density in the color development state.

Preferably, the coloring agent and the developer are homogeneously dispersed in a matrix of a binder to form the recording layer. If desired, the coloring agent and the developer may be encapsulated in micro-capsules. The binder may be, for example, a polyvinyl chloride resin, a polyvinyl acetate resin, a vinyl chloride-vinyl acetate copolymer, ethylcellulose, a polystyrene resin, a styrene copolymer, a phenoxy resin, an aliphatic or aromatic polyester resin, a polyurethane resin, a polycarbonate resin, a poly(meth)acrylate resin, poly(meth)acrylic acid resin, a (meth)acrylic acid copolymer, a maleic acid copolymer, a polyvinyl alcohol resin, hydroxyethylcellulose, carboxymethylcellulose and starch. These binders may be used by themselves or as a mixture of two or more. The binder serves to maintain the coloring agent and the developer in a homogeneously dispersed state when the recording layer is heated for recording and erasing. Thus, it is preferred that the binder have a high resistance to heat. For this reason, the binder may be suitably cross-linked after the formation of the thermosensitive recording layer by irradiation with UV rays, an electron beam or by heating.

Various kinds of additives which are customarily employed in conventional thermosensitive recording materials may be also incorporated into the recording layer to improve the coating properties and to upgrade the recording characteristics as necessary. Such additives may include a dispersant, a surface active agent, an electroconductivity imparting agent, a filler, a colored image stabilizer, an antioxidant, a light stabilizer, a UV absorbing agent, a decolorization accelerating agent and a lubricant.

The thermosensitive recording layer is preferably formed on The support by first compositing the coloring agent and the developer. This may be carried out by dissolving the two ingredients in a suitable solvent and drying the solution or by fusing the two ingredients together and solidifying the fused mass. A coating liquid containing the composited coloring agent and the developer is then prepared using a suitable solvent or dispersing medium and the solution or dispersion is applied onto the support by any known coating method to form the recording layer.

In addition to the thermosensitive recording layer, the thermosensitive recording medium according to the present invention may includes a protecting layer, an adhesive layer, an intermediate layer, an undercoat layer and/or a backcoat layer.

The protecting layer is provided on the thermosensitive recording layer for improving the durability thereof. The protecting layer also serves to prevent the deformation or color change of the surface of the recording medium by heat and pressure applied thereto during recording with a thermal head. Polyvinyl alcohol, a styrene-maleic anhydride copolymer, carboxy-modified polyethylene, a melamine-formaldehyde resin, a urea-formaldehyde resin or other UV- or electron beam-hardenable resins may be suitably used for the formation of the protecting layer. An additive such as a UV absorbing agent may be incorporated into the protecting layer.

The intermediate layer is provided between the protecting layer and the thermosensitive recording layer for improving the adhesion therebetween, for preventing deterioration of the recording layer by interaction with the protecting layer. The undercoat layer is provided between the support and the thermosensitive recording layer for improving the heat insulating properties and thereby enhancing the effective utilization of the heat applied to the recording medium during recording and erasing. The undercoat layer also serves to prevent the penetration of a coating liquid of the thermosensitive recording layer during fabrication of the recording medium.

The above-described binder resin for the recording layer may be suitably used for the formation of the intermediate and undercoat layers.

A filler such as calcium carbonate, magnesium carbonate, titanium oxide, silicon oxide, aluminum hydroxide, kaolin or talc, a lubricant and/or a surfactant may be suitably incorporated into the protecting layer, intermediate layer and/or undercoat layer.

If desired, the thermosensitive recording medium may further includes another recording layer such as a magnetic recording layer or an ordinary irreversible thermosensitive layer. Such an additional recording layer may be formed on the support.

The thermosensitive recording layer can assume a color development state and a decolorization state depending upon the thermal hysteresis thereof. Namely, the recording layer is capable of:

(a) assuming the color development state when heated to a first temperature at which the coloring agent and the developer are fused, (b) maintaining the color development state when rapidly cooled to room temperature, (c) assuming the decolorization state when heated to a second temperature which is lower than the first temperature, and (d) maintaining the decolorization state when cooled to room temperature.

The reversible color development and decolorization will be described in more detail with reference to FIG. 1. The layer in a low temperature decolorization state A is colored to assume a high temperature color development state B when heated at a temperature higher than $T_1$ at which the layer is fused, as shown by the solid line. The colored layer retains the color development state when rapidly cooled to room temperature and assumes a low temperature color development state C. When gradually cooled, however, the layer returns to the low temperature decolorization state A as shown by the dotted line. When the layer in the low temperature color development state C is heated, decolorization occurs at a temperature $T_2$ as shown by the broken line. The layer thus assumes a high temperature decolorization state D at a temperature below $T_1$. The layer in the state D, when cooled to room temperature, returns to the low temperature decolorization state A.

In the color development state, the coloring agent and the developer are considered to form aggregates in which the coloring agent molecules are in contact with the developer molecules. In the decolorization state, the aggregates are destroyed and the developer phase is separated from the coloring agent phase by, for example, crystallization of the developer.

The color developing temperature and decolorization temperature vary depending upon the kind of the developer and coloring agent and can be suitably determined according to the intended use of the thermosensitive recording medium. The optical density of the developed image in the fused state (at a temperature of $T_1$ or higher) is sometime different from that in the rapidly cooled state. For example, a certain thermosensitive recording layer is colorless in the fused state but is colored when rapidly cooled. Such a thermosensitive coloring composition or a recording medium is included within the scope of the present invention.

The image formation may be suitably carried out by heating the recording layer at above $T_1$ with a thermal head or a laser beam for a short period of time. Since the temperature increases locally, the heated area is rapidly cooled as a result of the diffusion of the heat as soon as the heating is stopped. Thus, by heating the thermosensitive recording layer imagewise, a desired pattern may be formed. To erase the image, on the other hand, the thermosensitive layer is either heated at above $T_1$ or between $T_2$ and $T_1$ for a long period of time with a thermal head and then allowed to cool to room temperature or heated for a short period of time at a temperature between $T_2$ and $T_1$. In the former case, since the recording medium as a whole is heated by the long period heating, the recording layer is gradually cooled, so that the erasure takes place. A heat roller, a heat stamp, hot air or a thermal head may be used for the former case of erasure. In the latter case, a thermal head, a heat roller or a heat stamp may be used. By controlling the energy applied to a thermal head by the adjustment of the impressed voltage and/or pulse, the thermosensitive recording layer can be heated with a single thermal head to temperatures suitable for color development and for decolorization. In this case, it is possible to perform overwriting.

The following examples will further illustrate the present invention. Parts and Percentages are by weight.

EXAMPLE 1

A mixture of 2-(o-chloroanilino)-6-dibutylaminofluoran and Developer No. 3 shown in Table 1—1 (molar ratio of the fluoran to developer: 1:5) was pulverized in a mortar. A glass plate with a thickness of 1.2 mm was heated at 170° C. with a hot plate and the above pulverized mixture was placed on the heated glass plate. As a result, the mixture was fused and turned black. A cover glass was then placed on the fused mixture to spread same into a uniform thickness. The spread mixture on the glass plate was immersed in ice water to solidify the mixture and to obtain a thin film of a thermosensitive coloring composition.

The thus obtained composition in the form of a film was heated at a speed of 4° C./minute. As a result, the composition was found to decolorize at a temperature in the range of about 60°–120° C.

Further, when the composition in the form of a film was placed on a hot plate at 110° C., decolorization occurred instantaneously. When the decolorized sample was heated to 170° C., the sample was fused and turned black.

Thus, it was revealed that the above composition was capable of reversibly assume the colored and decolorized states.

EXAMPLES 2–8

Example 1 was repeated in the same manner as described except that Developer No. 3 was substituted by Developer No. 2 (Example 2), Developer No. 4 (Example 3), Developer No. 5 (Example 4), Developer No. 7 (Example 5), Developer No. 8 (Example 6), Developer No. 34 (Example 7) and Developer No. 51 (Example 8). It was found that each of the compositions was capable of reversibly assume the colored and decolorized states.

EXAMPLE 9

The following components were placed in a ball mill and ground to a particle size of 1–4 μm and to obtain a coating liquid in the form of a dispersion.

| | |
|---|---|
| 2-(o-chloroanilino)-6-dibutylaminofluoran | 2 parts |
| Developer No. 3 | 8 parts |
| Vinyl chloride-vinyl acetate copolymer (VYHH manufactured by Union Carbide Inc.) | 10 parts |
| Methyl ethyl ketone | 45 parts |
| Toluene | 45 parts |

The coating liquid was then applied on a polyester film with a thickness of 100 μm by a wire bar and the coating was dried to obtain a thermosensitive recording medium having a thermosensitive recording layer with a thickness of about 6.0 μm provided on the polyester film.

EXAMPLE 10

Example 9 was repeated in the same manner as described except that Developer No. 8 was substituted for Developer No. 3.

EXAMPLE 11

The following components were placed in a ball mill and ground to a particle size of 1–4 μm and to obtain a coating liquid in the form of a dispersion.

| | |
|---|---|
| 2-anilino-3-methyl-6-dibutylaminofluoran | 4 parts |
| Developer No. 2 | 8 parts |
| Vinyl chloride-vinyl acetate copolymer (VYHH manufactured by Union Carbide Inc.) | 12 parts |
| Methyl ethyl ketone | 110 parts |

The coating liquid was then applied on a polyester film with a thickness of 100 μm by a wire bar and the coating was dried to obtain a thermosensitive recording medium having a thermosensitive recording layer with a thickness of about 6.0 μm provided on the polyester film.

EXAMPLES 12–17

Example 11 was repeated in the same manner as described except that Developer No. 2 was substituted by Developer No. 3 (Example 12), Developer No. 4 (Example 13), Developer No. 7 (Example 14), Developer No. 8 (Example 15), Developer No. 34 (Example 16) and Developer No. 51 (Example 17).

COMPARATIVE EXAMPLE 1

Example 9 was repeated in the same manner as described except that Developer No. 3 was substituted by eicosylsulfonic acid and that 2-(o-chloroanilino)-6-dibutylaminofluoran was substituted by 2-anilino-3-methyl-6-(N-ethyl-N-p-tolylamino)fluoran.

Each of the thermosensitive recording media thus obtained in Examples 9–17 and Comparative Example 1 was tested for the image density upon development and erasure. Thus, the sample was recorded with a thermal head of 8 dots/mm at an applied voltage of 13.3 V and a pulse width of 1.2 msec. The image density in the color development state was measured with McBeath densitometer RD-914. The sample was then placed in a thermostat oven maintained at 130° C. (Examples 9, 12 and 14), 120° C. (Examples 10, 11, 13 and 15), 110° C. (Examples 16 and 17) and 85° C. (Comparative Example 1) for about 20 seconds to erase the developed image. The image density in the decolorization state was measured with McBeath densitometer RD-914. The above recording and erasure operations were repeated 10 times and the image densities in the color development state and in the decolorization state were measured. The results are summarized in Table 2. It was found that all of the recording media of the present invention were able to reversibly and repeatedly assume the color development and decolorization states. The image density of the recording medium of Comparative Example 1 was lower than those of the present invention and the erasability thereof was not good.

TABLE 2

| | | Image Density | | | |
|---|---|---|---|---|---|
| | Back- | Development State | | Decolorization State | |
| Example | ground Density | Initial | After 10 times | Initial | After 10 times |
| 9 | 0.08 | 1.30 | 1.28 | 0.07 | 0.08 |
| 10 | 0.11 | 1.27 | 1.26 | 0.10 | 0.11 |
| 11 | 0.12 | 1.24 | 1.23 | 0.15 | 0.16 |
| 12 | 0.10 | 1.28 | 1.27 | 0.09 | 0.10 |
| 13 | 0.11 | 1.23 | 1.22 | 0.12 | 0.12 |
| 14 | 0.10 | 1.25 | 1.25 | 0.10 | 0.10 |
| 15 | 0.10 | 1.26 | 1.25 | 0.10 | 0.10 |
| 16 | 0.10 | 1.28 | 1.26 | 0.10 | 0.10 |
| 17 | 0.10 | 1.24 | 1.23 | 0.10 | 0.10 |
| Comp. 1 | 0.15 | 1.10 | 1.08 | 0.41 | 0.42 |

The above recording media were also tested for the adaptability to high speed erasing by contacting with a heated block at a temperature shown in Table 3 for 1 second with a contact pressure of 2 kg/cm$^2$. It was revealed that the image density of the recording media of the present invention in the decolorization state was almost the same as the background density. On the other hand, the recording medium of Comparative Example 1 was not able to be erased with the 1 second heating. It took about 1 minute in order to reduce the density to 0.16.

TABLE 3

| | Back- | Erasing | Image Density | |
|---|---|---|---|---|
| Example | ground Density | Temperature (°C.) | Development State | Decolorization State |
| 9 | 0.08 | 150 | 1.30 | 0.08 |
| 10 | 0.11 | 150 | 1.27 | 0.11 |
| 11 | 0.12 | 130 | 1.24 | 0.15 |
| 12 | 0.10 | 150 | 1.28 | 0.09 |
| 13 | 0.11 | 140 | 1.23 | 0.12 |
| 14 | 0.10 | 150 | 1.25 | 0.10 |
| 15 | 0.10 | 140 | 1.26 | 0.11 |
| 16 | 0.10 | 130 | 1.28 | 0.10 |
| 17 | 0.10 | 130 | 1.24 | 0.10 |
| Comp. 1 | 0.15 | 90 | 1.10 | 0.45 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A reversible thermosensitive recording medium, comprising a support, and a thermosensitive recording layer supported on said support and including a coloring agent, and a developer capable of reacting with said coloring agent to develop a color, said color developer being a carboxylic acid having the following formula (I):

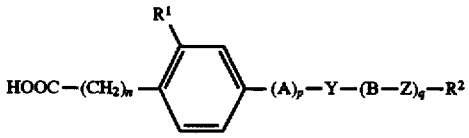

(I)

wherein $R^1$ stands for a substituent selected from the group consisting of a hydrogen atom, a halogen atom, a hydroxyl group, an alkyl group and an alkoxy group, $R^2$ stands for an aliphatic hydrocarbon group having at least 8 carbon atoms, A stands for a divalent aliphatic hydrocarbon group, B stands for a divalent group selected from the group consisting of substituted and non-substituted aromatic groups and substituted and non-substituted aliphatic groups, Y stands for a divalent group containing at least one hereto atom, Z stands for a divalent group containing at least one hetero atom, n is an integer of 1–3 and p and q are each an integer of 0 or 1, wherein said recording layer is capable of:

(a) assuming a color development state when heated at a first temperature at which said coloring agent and said developer are fused and then rapidly cooled to room temperature, and (b) assuming a decolorization state when heated to a second temperature which is lower than said first temperature and maintaining said decolorization state when cooled to room temperature.

2. A recording medium as claimed in claim 1, wherein said divalent groups Y and Z stand, independently from each other, for a group containing at least one linkage selected from the group consisting of —NH—, —CO—, —O—, —S— and —$SO_2$—.

3. A recording medium as claimed in claim 1, wherein said divalent group Y and Z stand, independently from each other, for a member selected from the group consisting of —NHCONH—, —NHCO—, —CONH—, —NHCSNH—, —OCONH—, —NHCOO—, —OCSNH—, —NHCSO—, —NH—, —N=CH—, —CH=N—, —SCO—, —COS—, —OCO—, —COO—, —O—, —S—, —$SO_2$—, —$SO_2$NH—, —NH$SO_2$—, —CO—, —O—CO—O—, —S—S—, —CO—NH—CO—, —CO—NH—CO—NH—, —NH—CO—NH—CO—, —CO—NH—NH—CO—, —NH—CO—CO—NH—, —CO—NH—NH—CO—O—, —CO—NH—NH—CO—NH—, —NH—CO—NH—NH—CO—, —NH—CO—NH—NH— and —NH—NH—CO—NH—, said divalent aliphatic hydrocarbon group A stands for an alkylene group and said divalent group B stands for an alkylene group or a phenylene group.

* * * * *